United States Patent [19]

Schinzing

[11] Patent Number: 4,583,647

[45] Date of Patent: Apr. 22, 1986

[54] RACK FOR HANGING BATS OR OTHER OBJECTS

[76] Inventor: Walter W. Schinzing, 1932 Gervais, Maplewood, Minn. 55109

[21] Appl. No.: 720,134

[22] Filed: Apr. 5, 1985

Related U.S. Application Data

[63] Continuation-in-part of Ser. No. 462,081, Jan. 28, 1983, abandoned.

[51] Int. Cl.[4] ..... A47F 5/08

[52] U.S. Cl. ..... 211/60.1; 211/70.6; 211/66; 211/87

[58] Field of Search ..... 211/60.1, 70.6, 75, 211/13, 14, 87, 65, 66; 248/220.2, 220.4, 221.4

[56] References Cited

U.S. PATENT DOCUMENTS

| | | | |
|---|---|---|---|
| 944,312 | 12/1909 | Brede | 211/70.6 |
| 1,791,872 | 1/1919 | Heinze | 211/87 |
| 2,503,737 | 4/1950 | Hodgkins | 211/70.1 X |
| 2,772,787 | 12/1956 | Lee | 211/75 |
| 2,773,473 | 12/1956 | Martin | 248/220.2 X |
| 3,269,550 | 8/1966 | Marcus | 211/70.6 X |
| 3,650,407 | 3/1972 | Berhan | 211/14 |
| 3,698,563 | 10/1972 | Gordon et al. | 211/13 |
| 3,858,725 | 1/1975 | Pietrack et al. | 211/90 X |
| 4,049,126 | 9/1977 | Halverson | 211/104 |
| 4,241,836 | 12/1980 | Cousins | 211/14 |

FOREIGN PATENT DOCUMENTS

| | | | |
|---|---|---|---|
| 2037481 | 2/1972 | Fed. Rep. of Germany | 248/220.2 |

*Primary Examiner*—Robert W. Gibson, Jr.
*Attorney, Agent, or Firm*—Thomas B. Tate

[57] ABSTRACT

The invention is a portable rack formed as a molded unit having a plurality of niches formed in a horizontal ledge portion to support a plurality of bats or other objects in a vertical position, and guide arms and adjustable clip means affixed to the back of a vertical mounting plate to enable the device to be mounted on a wire-screen backstop, or alternatively, screw disposed through openings in the vertical mounting plate to enable the device to be mounted on an interior building wall.

1 Claim, 4 Drawing Figures

RACK FOR HANGING BATS OR OTHER OBJECTS

SUMMARY AND BACKGROUND OF THE INVENTION

This application is a continuation-in-part of Ser. No. 462,081, filed Jan. 28, 1983, now abandoned.

The principal embodiment of the invention is a portable bat rack suitable for mounting onto a chain-link fence or backstop.

Ballparks used by professional teams have dugouts equipped with a floor-mounted bat rack for storage of bats. However, most amateur baseball and softball teams play on fields which are not equipped with these facilities. Therefore amateur players customarily insert their bats into the openings of the backstop for storage between turns at bat. The disadvantage of this method is that part of the bat projects beyond the screen onto the playing field, where it can be hit by a batted or thrown ball and thus obstruct the play of the game.

A primary object of the invention is to avoid this problem by providing a means for storing bats which can be mounted on the back side of the backstop and thus out of the field of play.

Another object of the invention is to provide an easier means for transporting bats to and from the ballpark.

An alternative embodiment of the invention is a rack which differs in the mounting means, this variation being suitable for mounting on a wall for storing sporting goods, tools, garden supplies, or objects when not in use. This version of the invention can hold about eleven to fourteen items at a time.

DESCRIPTION OF VIEWS OF THE DRAWING

FIG. 1 is a front perspective view. FIG. 2 is a bottom perspective view. FIG. 3 is a back view.

DESCRIPTION OF THE PRINCIPAL EMBODIMENTS OF THE INVENTION

Figure 1:
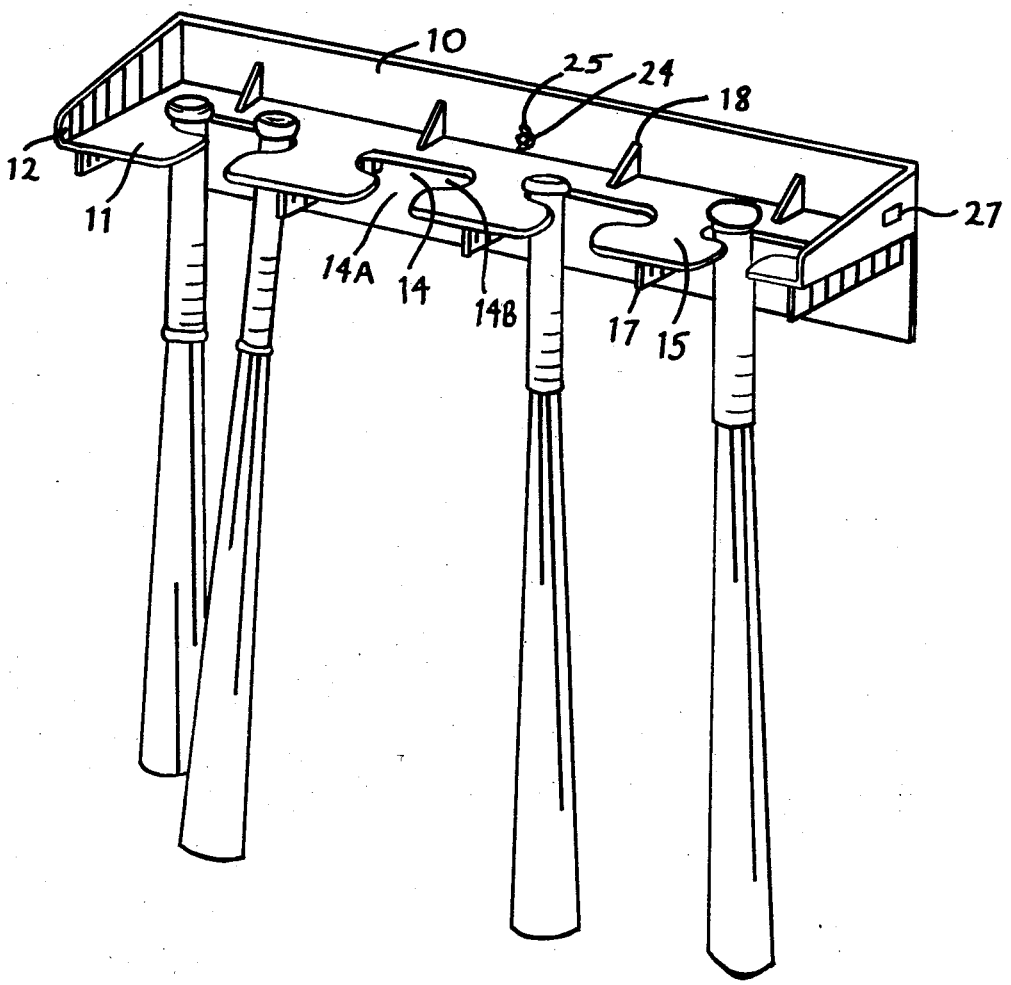
FIGS. 1, 2, and 3 depict the principal embodiment of the invention.
Figure 2:
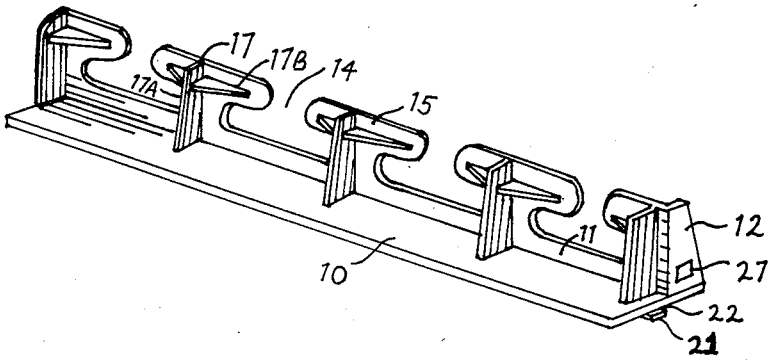
Figure 3:
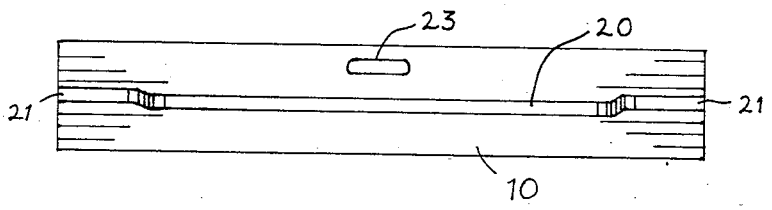
Figure 4:
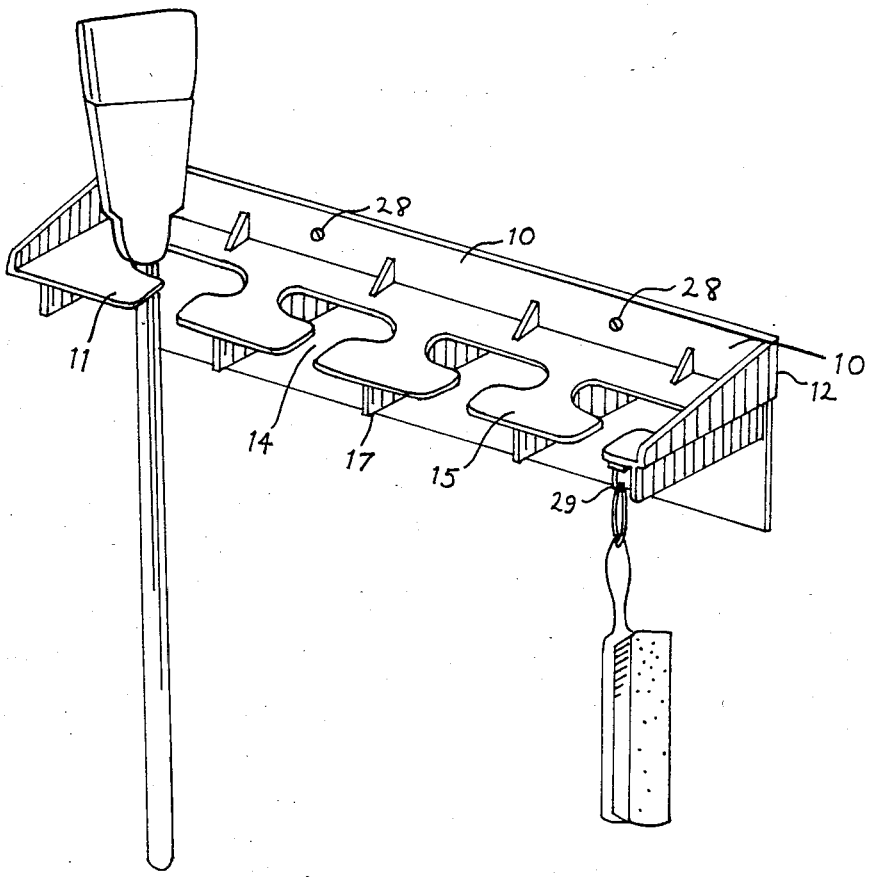
FIG. 4 is a front perspective view of the alternative embodiment of the invention.

The principal embodiment of the invention is a portable bat rack which can be mounted onto a chain-link fence or backstop to store baseball or softball bats conveniently, but out of the field of play, during a game.

The rack is molded as a single unit from high-impact polystyrene plastic. The vertical mounting plate 10 rests flat against the backstop upon which the rack is to be mounted. The horizontal bat-supporting ledge 11 projects perpendicularly from the front of the mounting plate 10, slightly above the midline of the mounting plate 10, and parallel to the plane of the ground. Two end plates 12, which form right angles with the mounting plate 10 and with the ledge 11, and which slope diagonally from back to front, provide additional strength and stability.

The ledge 11 defines a plurality (four in the preferred embodiment) of niches 14, each capable of supporting two bats. Each niche 14 has a neck portion 14A through which the handle of a bat is inserted, and a main portion 14B which is elliptical and has a diameter slightly smaller than the knob at the end of a bat handle, thus allowing the bat to be supported in an upside-down position.

Each of the flange-like portions 15 of the ledge 11, which are located between the niches 14 are provided, on their undersides, with bracing means 17, which comprise a vertical trapezoidal brace 17A which forms a cross-shaped (half-cross on the end flanges) pattern with the horizontal triangular braces 17B. Smaller triangular braces 18 connect the top surface of the ledge 11 with the front of the mounting plate 10, opposite the neck openings 14A of each of the niches 14.

Extending horizontally along the midline of the back side of the mounting plate 10 is a raised strip 20 which, at either end, juts out slightly at approximately a forty-five degree angle, then returns to parallel with the mounting plate 10 to form guide arms 21 which define slots 22 between the guide arms 21 and the mounting plate 10. When the rack is mounted onto a backstop, the fence is inserted first into the slot 22 at one end and then into the slot 22 at the other end. plate 10, between the strip 20 and the top edge of the mounting plate 10, approximately equidistant from either end of the mounting plate 10. The clip 23 has an opening drilled into it, through which is inserted a bolt 24 which projects through the front of the mounting plate 10. The bolt 24 is provided with a wing nut 25 which can be tightened against the front of the mounting plate 10. The clip 23 is the part which actually holds the rack onto the fence. The fence is inserted between the clip 23 and the back of the mounting plate 10, and the wing nut 25 is tightened to hold the bat rack in position.

One of the end plates 12 has affixed to it a Velcro pad 27 to which a hand towel (which also has a Velcro pad) can be affixed to keep bats and players' hands dry during the game.

An alternative embodiment of the invention can be mounted on a wall in a garage, basement, or the like, and can be used to store sporting goods, tools, garden supplies, and miscellaneous items. This version of the invention lacks the strip 20 and clip 23. Instead it is mounted on the wall by means of two screws 28 which are inserted into openings sixteen inches apart in the mounting plate 10 and are screwed into the wall studs to hold the rack onto the wall. This form of the invention is equipped with stick-on hooks 29 which attach to the bottom of the ledge 11 to provide additional hanging means.

It is intended that the scope of the invention encompass additional minor variations, for example, where the rack is to be mounted onto a wall which has studs at intervals other than the standard sixteen inches, the screws could be positioned at intervals other than sixteen inches, corresponding to the intervals betwwen studs, or as another example, bat racks with a greater or lesser number of niches, which do not depart from the spirit of the invention.

I claim:

1. A rack which can be mounted onto a chain-link fence or backstop to support sporting equipment in a substantially vertical position, said rack being a molded unit comprising:

an elongated, rectangular vertical mounting plate;

a horizontal supporting ledge projecting perpendicularly from said mounting plate;

end plates at either end connecting said mounting plate to said supporting ledge at right angles to each;

a plurality of niches formed into said supporting ledge, each niche comprising a neck through which an object to be stored may be inserted, and a main elliptical portion perpendicular to said neck, the diameter of said elliptical portion being small enough to contact the handle of the object to be supported;

said ledge having a plurality of flanges defined by and located between said niches and between said niches and said end plates;

cross-bracing means positioned on the underside of each of said flanges;

means for mounting said rack onto said fence or backstop, said means comprising:

a strip extending horizontally across the back of said mounting plate;

guide arms formed at either end of said strip, each guide arm being parallel to said mounting plate and defining a slot between said mounting plate and each said guide arm into which links of said backstop may be inserted;

and adjustable clip means for tightening said rack against said links of said fence, said adjustable clip means being bolted through an opening in said mounting plate and being adjustable by wing nut means.

* * * * *